United States Patent [19]

Sugasawa

[11] 4,284,056

[45] Aug. 18, 1981

[54] SPLIT-TYPE INTERNAL COMBUSTION ENGINE

[75] Inventor: Fukashi Sugasawa, Yokohama, Japan

[73] Assignee: Nissan Motor Company, Limited, Yokohama, Japan

[21] Appl. No.: 122,989

[22] Filed: Feb. 20, 1980

[30] Foreign Application Priority Data

Feb. 28, 1979 [JP] Japan ..... 54-22962

[51] Int. Cl.[3] ..... F02M 25/06

[52] U.S. Cl. ..... 123/568; 123/198 F; 123/571

[58] Field of Search ..... 123/568, 571, 198 F

[56] References Cited

U.S. PATENT DOCUMENTS

| | | | |
|---|---|---|---|
| 3,270,724 | 9/1966 | Dolza | 123/568 X |
| 4,106,471 | 8/1978 | Nakajima et al. | 123/198 F |
| 4,185,607 | 1/1980 | Thornburgh | 123/198 F |
| 4,192,278 | 3/1980 | Iizuka et al. | 123/198 F |
| 4,201,180 | 5/1980 | Iizuka et al. | 123/198 F |
| 4,231,338 | 11/1980 | Sugasawa et al. | 123/568 |

FOREIGN PATENT DOCUMENTS

| | | | |
|---|---|---|---|
| 2628091 | 1/1977 | Fed. Rep. of Germany | 123/198 F |
| 2853455 | 6/1979 | Fed. Rep. of Germany | 123/198 F |
| 2900953 | 7/1979 | Fed. Rep. of Germany | 123/198 F |
| 2911555 | 9/1979 | Fed. Rep. of Germany | 123/198 F |
| 2413547 | 8/1979 | France | 123/198 F |

*Primary Examiner*—Wendell E. Burns

*Attorney, Agent, or Firm*—Schwartz, Jeffery, Schwaab, Mack, Blumenthal & Koch

[57] ABSTRACT

An internal combustion engine is disclosed which is operable on less than all of its cylinders with recirculation of exhaust gases into the inactive cylinders under low load conditions. The engine has an intake passage provided therein with an air metering throttle valve and divided downstream of the throttle valve into first and second branches leading to the active and inactive cylinders, respectively. The second branch has therein valve means adapted to close so as to define a seal chamber with the inner surface of the second branch during a split engine operation. The seal chamber is communicated with the intake passage upstream of the throttle valve for introduction of air into the chamber.

5 Claims, 5 Drawing Figures

SPLIT-TYPE INTERNAL COMBUSTION ENGINE

BACKGROUND OF THE INVENTION

1. Field of the Invention

This invention relates to a split-type multi-cylinder internal combustion engine operable on less than all of its cylinders under low load conditions but on all of the cylinders when the engine load exceeds a predetermined value.

2. Description of the Invention

It is generally known that internal combustion engines exhibit better fuel combustion and thus higher fuel economy when running under higher load conditions. In view of this fact, split type internal combustion engines have already been proposed which operate on less than all of the cylinders under low load conditions and on all of the cylinders when the engine load exceeds a given value. That is, under low load conditions, some of the cylinders are held inactive so that the other active cylinders can operate with relatively high loads. This is effective to achieve high fuel economy.

One difficulty with such split-type internal combustion engines is that during a split engine operation, air is discharged from the inactive cylinders to the exhaust system of the engine to cause a reduction in the temperature of the exhaust gases flowing through the catalyzer provided in the exhaust systems to thereby spoil its exhaust emission purifying performance.

In order to eliminate this disadvantage, an improved split-type internal combustion engine has been provided which has its intake passage bifurcated, downstream of the throttle valve, into first and second branches, the first branch leading to the active cylinders and the second branch leading to the inactive cylinders. The second branch has therein an air stop valve adapted to close during a split engine operation. The exhaust passage of the engine is divided, upstream of the catalyzer, into first and second branches, the first branch leading to the active cylinders and the second branch leading to the inactive cylinders. The engine also has an exhaust gas recirculation (EGR) passage having its one end opening into the second intake passage branch and the other end opening into the second exhaust passage branch. The EGR passage has therein an EGR valve adapted to open during a split engine operation.

During a split engine operation, substantially all of the exhaust gases discharged from the inactive cylinders is recirculated thereinto. This is effective to maintain the catalyzer at a high temperature conductive to its maximum performance and to reduce pumping losses in the inactive cylinders.

With such a conventional split engine, however, there is the possibility of escape of exhaust gases from the second intake passage branch to the first intake passage branch during a split engine operation due to a great pressure differential occurring across the air stop valve during a split engine operation. This results in imcomplete fuel combustion in the active cylinders.

SUMMARY OF THE INVENTION

In view of the foregoing, it is a main object of the present invention to provide an improved split-type internal combustion engine which can avoid the possibility of leakage of exhaust gases from its inactive cylinders to its active cylinders and ensure smooth engine operation during a split engine operation.

BRIEF DESCRIPTION OF THE DRAWINGS

The invention will become fully apparent from the following detailed description taken in conjunction with the accompanying drawings, in which.

DESCRIPTION OF THE PREFERRED EMBODIMENTS

Figure 1:
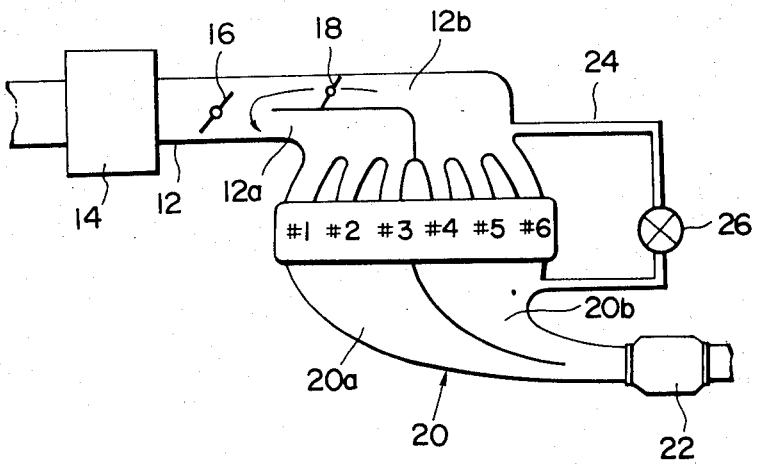
FIG. 1 is a schematic view showing a conventional split-type internal combustion engine.

Prior to the description of the preferred embodiments of the present invention, we shall briefly describe the prior art split-type internal combustion engine in FIG. 1 in order to specifically point out the difficulties attendant thereon.

Referring to FIG. 1, the conventional split-type internal combustion engine is shown as six cylinders split into active cylinders #1 to #3 and inactive cylinders #4 to #6 held inactive during a split engine operation. The engine has an intake passage 12 provided therein with an air flow meter 14 and an air metering throttle valve 16. The intake passage 12 is divided, downstream of the throttle valve 16, into first and second branches **12*a* and 12*b*. The first intake passage branch 12*a* leads to the active cylinders #1 to #3 and the second intake passage branch 12*b* leads to the inactive cylinders #4 to #6. The second intake passage branch 12*b* has therein an air stop valve 18 adapted to close during a split engine operation. The engine has an exhaust passage 20 provided therein with a catalyzer 22. The exhaust passage 20 is divided, upstream of the catalyzer 22, into first and second branches 20*a* and 20*b*. The first exhaust branch 20*a* leads from the active cylinders #1 to #3 and the second exhaust passage branch 20*b* leads from the inactive cylinders #4 to #6**.

An exhaust gas recirculation (EGR) passage 24 is provided which has its one end opening into the second intake passage branch **12*b* and the other end opening into the second exhaust passage branch 20*b*. The EGR passage 24 is provided therein with an EGR valve 26** which is adapted to open to allow exhaust gas recirculation to reduce pumping losses in the inactive cylinders during a split engine operation.

One difficulty with such a conventional arrangement is the possibility of leakage of exhaust gases from the second intake passage branch **12*b* to the first intake pressure branch 12*a* during a split engine operation where the first intake passage branch 12*a* is held at a high vacuum while the second intake passage branch 12*b* is held substantially at atmospheric pressure due to exhaust gas recirculation to create a great pressure differential across the air stop valve 18. Such exhaust gas leakage causes incomplete fuel combustion in the active cylinders #1 to #3**, resulting in insufficient engine output and increased pollutant emissions. This is true particularly where engine split operation is effected at idle conditions under which exhaust gases in the active cylinders becomes readily in excess by the escaping exhaust gases.

Figure 2:
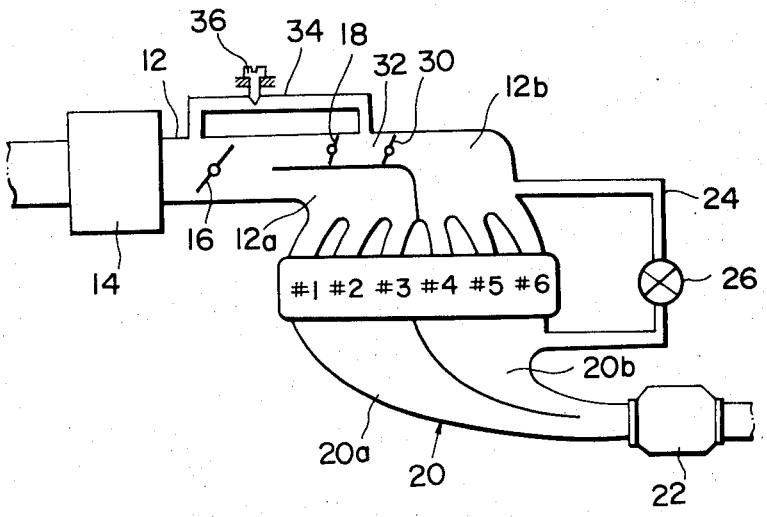
FIG. 2 is a schematic view of a split-type internal combustion engine utilizing a seal arrangement in accordance with the present invention.

Referring to FIG. 2, there is illustrated a split-type internal combustion engine utilizing a seal arrangement made in accordance with the present invention. Parts in FIG. 2 which are like those in FIG. 1 have been given the same reference numeral.

In this embodiment, the second intake passage branch 12*b* has therein a second air stop valve 30 located downstream of the first air stop valve 18. The second air stop valve 30 is drivingly connected to the first air stop valve 18 and closes during a split engine operation so as to define a seal chamber 32 therewith. A bypass passage 34 is provided which has its one end opening into the intake passage 12 between the air flow meter 14 and the air metering throttle valve 16 and the other end opening into the seal chamber 32.

During a split engine operation, the bypass passage 34 introduces air into the seal chamber 32 to equalize the pressures across the second air stop valve 30. This fully precludes the likelihood of leakage of exhaust gases from the second intake passage branch 12*b* to the first intake passage branch 12*a* although air would escape from the seal chamber 32 to the first intake passage branch 12*a* through the first stop valve 18. Since the air charged in the seal chamber 32 is a part of the air having passed the air flow meter 14, the air escaping through the first stop valve 18 into the first intake passage branch 12*a* has no effect on the air-fuel ratio in the active cylinders. The second air stop valve 30 opens along with the first air stop valve 18 to allow fresh air to flow into the cylinders #4 to #5 during a full engine operation.

Air flow control means 36 may be provided for metering the flow of air flowing through the bypass passage 34 if split engine operation is effected under low load conditions in order to minimize engine vibrations at idle conditions.

Figure 3:
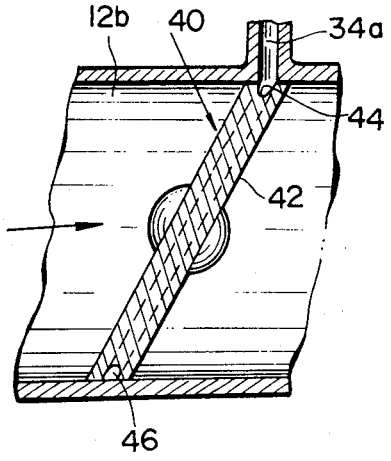
FIG. 3 is a fragmentary sectional view of a seal arrangement embodying a second form of the present invention.

Referring to FIG. 3, there is illustrated a second form of the seal arrangement of the present invention, in which the first and second stop valves 18 and 30 of FIG. 2 are removed and instead a butterfly type stop valve 40 is provided in the second intake passage branch 12*b*. The stop valve 40 has a disc-shaped valve plate 42 formed in its peripheral surface with an annular groove 44 which defines an annular seal chamber 46 with the inner surface of the second intake passage branch 12*b* when the stop valve 40 is a closed position. The annular seal chamber 46 is placed in registry with one opening 34*a* of the bypass passage 34 in the closed position of the stop valve 40.

During a split engine operation, the stop valve 40 closes to form the annular seal chamber 46 which is charged with air through the bypass passage 34 to prevent leakage of exhaust gases through the stop valve 40 into the first intake passage branch 12*a*.

Figure 4:
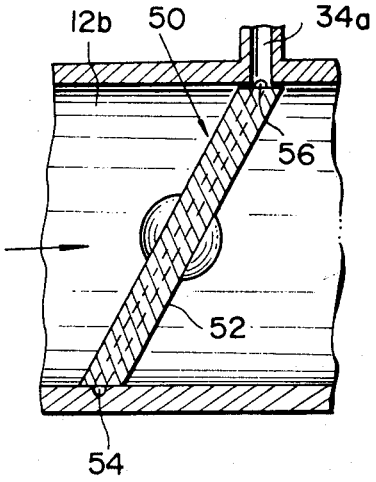
FIG. 4 is a fragmentary sectional view of a seal arrangement embodying a third form of the present invention.

Referring to FIG. 4, there is illustrated a third form of the seal arrangement of the present invention, in which a butterfly type stop valve 50 is provided in the second intake passage branch 12*b*. An annular groove 54 is formed in the inner surface of the second intake passage branch 12*b* such as to define an annular seal chamber 56 with the valve plate 52 of the stop valve 50 when the stop valve 50 is in its closed position. One opening 34*a* of the bypass passage 34 opens into the annular groove 54.

During a split engine operation, the stop valve 50 closes to form the annular seal chamber 56 which is charged with air through the bypass passage 34 to preclude the likelihood of leakage of exhaust gases through the stop valve 50 into the first intake passage branch 12*a*.

Figure 5:
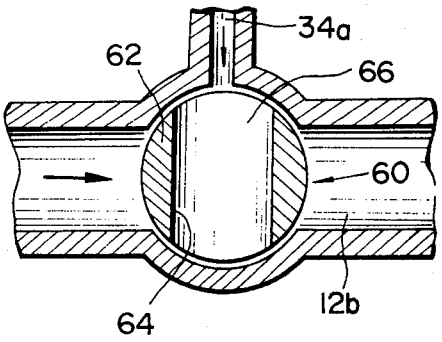
FIG. 5 is a fragmentary sectional view of a seal arrangement embodying a fourth form of the present invention.

Referring to FIG. 5, there is illustrated a fourth form of the seal arrangement of the present invention, in which a rotary type stop valve 60 is provided in the second intake passage branch 12*b*. The rotary valve 60 has its valve rotor 62 formed with a through-bore 64 such as to define a seal chamber 66 with the inner surface of the second intake passage branch 12*b* when the rotary valve 60 is in its closed position. The through-bore 64 comes in registry with one opening 34*a* of the bypass passage 34 at the closed position of the rotary valve 60.

During a split engine operation, the rotary valve 60 closes to form the seal chamber 66 which is charged with air through the bypass passage 34 to preclude leakage of exhaust gases through the stop valve 60 into the first intake passage branch 12*a*.

Split-type internal combustion engines with the seal arrangement of the present invention is free from the possibility of leakage of exhaust gases from its inactive cylinders to its active cylinders resulting in insufficient engine output and increased pollutant emissions.

While this invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) an air intake passage provided therein with an air metering throttle valve and divided downstream of said throttle valve into a first branch for supplying air to certain of the engine cylinders and a second branch for supplying air to the remainder of said engine cylinders;

(b) an exhaust passage through which exhaust gases are discharged from said engine cylinders to the atmosphere;

(c) an EGR passage provided therein with an EGR valve for recirculation of exhaust gases from said exhaust passage into said second intake passage branch;

(d) valve means provided in said second intake passage branch for defining a chamber therewith in the closed position of said valve means;

(e) passage means having its one end opening into said intake passage upstream of said throttle valve and the other end opening into said chamber; and (f) control means responsive to low engine loads for cutting off the supply of fuel for said remainder of said engine cylinders, opening said EGR valve, and closing said valve means.

2. An internal combustion engine according to claim 1, wherein said valve means comprises a pair of valves arranged in spaced relation longitudinally of said second intake passage branch so as to form said chamber therebetween.

3. An internal combustion engine according to claim 1, wherein said valve means comprises a butterfly valve having a disc-shaped valve plate formed in its peripheral surface with an annular groove defining said chamber with the inner surface of said second intake passage branch.

4. An internal combustion engine according to claim 1, wherein said valve means comprises a butterfly valve with its peripheral surface defining said chamber with an annular groove formed in the inner surface of said second intake passage branch.

5. An internal combustion engine according to claim 1, wherein said valve means comprises a rotary valve having a valve rotor formed with a through-bore defining said chamber with the inner surface of said second intake passage branch.

* * * * *